US005357863A

United States Patent [19]

McLean et al.

[11] Patent Number: 5,357,863

[45] Date of Patent: Oct. 25, 1994

[54] PRINTING BLANKET FOR USE WITH A PRINTING CYLINDER TO ACHIEVE A NARROW GAP LOCK-UP

[75] Inventors: Michael E. McLean; Thomas D. Hower, both of Waynesville; William H. Haddock, Chadler, all of N.C.; Wayne W. Easley, Centerville, Ohio; Melvin D. Pinkston, Hendersonville, N.C.; Charles L. Wilcox, Arden, N.C.; James C. Messer, Jr., Canton, N.C.

[73] Assignee: Day International, Inc., Dayton, Ohio

[21] Appl. No.: 792,820

[22] Filed: Nov. 15, 1991

[51] Int. Cl.[5] ..... B41F 27/02

[52] U.S. Cl. ..... 101/389.1; 101/415.1

[58] Field of Search ..... 101/376, 378, 382.1, 101/383, 389.1, 415.1

[56] References Cited

U.S. PATENT DOCUMENTS

| | | | |
|---|---|---|---|
| 2,375,603 | 5/1945 | Willard | 101/415.1 |
| 2,727,463 | 12/1955 | Foster | 101/415.1 |
| 2,752,280 | 6/1956 | Cooke et al. | 428/76 |
| 3,616,145 | 10/1971 | Clifton | 428/242 |
| 3,670,646 | 6/1972 | Welch, Jr. | 101/389.1 |
| 3,730,092 | 5/1973 | Pickard et al. | 101/415.1 |
| 4,090,302 | 5/1978 | Bollmer | 33/567 |
| 4,402,265 | 9/1983 | Pickard | 101/389.1 |
| 4,643,094 | 2/1987 | Holmstrom | 101/415.1 |
| 4,676,161 | 6/1987 | Peekna | 101/378 |
| 4,817,527 | 4/1989 | Wouch et al. | 101/389.1 |
| 4,829,896 | 5/1989 | Norkus | 101/486 |
| 4,854,237 | 8/1989 | Theilacker | 101/415.1 |
| 4,878,429 | 11/1989 | Russo | 101/486 |
| 4,932,324 | 6/1990 | Pinkston et al. | 101/486 |
| 4,974,512 | 12/1990 | Russo | 101/389.1 |
| 5,006,400 | 4/1991 | Pinkston et al. | 428/229 |
| 5,188,031 | 2/1993 | Depa et al. | 101/415.1 |

FOREIGN PATENT DOCUMENTS

| | | | |
|---|---|---|---|
| 2803908 | 8/1979 | Fed. Rep. of Germany | 101/415.1 |
| 59-209198 | 11/1984 | Japan . | |

*Primary Examiner*—Edgar S. Burr
*Assistant Examiner*—Stephen R. Funk
*Attorney, Agent, or Firm*—Killworth, Gottman, Hagan & Schaeff

[57] ABSTRACT

A printing blanket adapted to be used with a magnetic printing cylinder including a gap extending longitudinally along the outer surface thereof is provided. The printing blanket includes a plurality of plies with a magnetic backing ply which is magnetically adhered to the printing cylinder. The printing blanket is positioned on the printing cylinder such that an end of the printing blanket is bent over an edge and inwardly into the gap. The opposite end of the printing blanket is mounted substantially adjacent the opposite edge of the gap. A tensioning roll or similar device to which the printing blanket may be attached can be disposed in the gap to secure the printing blanket to the printing cylinder more firmly.

19 Claims, 5 Drawing Sheets

PRINTING BLANKET FOR USE WITH A PRINTING CYLINDER TO ACHIEVE A NARROW GAP LOCK-UP

BACKGROUND OF THE INVENTION

The present invention generally relates to a printing blanket construction, and more particularly, to an improved end design for a printing blanket adapted to be used with a magnetic printing cylinder. The type of printing blanket to which is referred herein is used primarily in offset lithographic printing, but may also find utility in other fields of printing.

In the art of offset lithography, a rotary cylinder is covered with a printing plate which normally has a positive image area receptive to oil-based inks and repellant to water and a background area where the opposite is true. The printing plate is rotated so that its surface contacts a second cylinder covered with an ink-receptive printing blanket having an elastomeric surface. The ink present on the image surface of the printing plate transfers, or offsets, to the surface of the printing blanket. A continuous paper web or sheet stock to be printed is then passed between the blanket-covered cylinder and a rigid back-up cylinder to transfer the image from the surface of the printing blanket to the paper.

The blanket-covered cylinders have to accommodate a mechanism to hold the printing blanket on the cylinder surface. This mechanism is typically located in a gap extending axially or longitudinally along the cylinder. Typically, these gaps will have a circumferential distance (width) of at least 0.18 inches. As a result, for every revolution of the blanket-covered cylinder, that portion of the web which passes the printing cylinder gap is not imprinted. This results in an increase in operating costs which may be attributed to several factors including the need for printing cylinders having larger diameters to achieve the desired page length and the wasted paper produced from such gaps. Moreover, the cylinders in a typical offset printing apparatus rotate at high speeds and with substantial pressure between the cylinders, thereby providing a structural environment in which the gaps cause shock and vibrations degrading the printing quality and contributing to printing apparatus wear. In addition, the gaps destroy the symmetry of the cylinders which is an undesirable condition for high speed rotation. As a result, the rotational speed of the blanket-covered cylinders must be limited. Accordingly, it would be desirable to have printing apparatus which provide a narrow gap on the blanket-covered cylinder.

In response to such problems, cylinders to which a printing blanket is held magnetically have been proposed. Magnetic cylinders in combination with magnetic printing blankets have been used in attempts to produce a narrow gap functionally approaching a continuous printing blanket. For example, Clifton, U.S. Pat. No. 3,616,145 provides a magnetized printing blanket adapted to be self-attached to a printing cylinder and Pickard et al, U.S. Pat. No. 3,730,092 provide a magnetic blanket retained on a printing cylinder using a plate and a top sheet, both of which are mounted in the gap of the printing cylinder. While offset printing apparatus having the combination of a magnetic printing blanket and a magnetic printing cylinder may result in a slightly narrower gap, they do not exhibit sufficient holding capabilities for reliable operation in high speed offset printing operations nor do they achieve a narrow gap functionally approaching a continuous printing blanket. More specifically, the centrifugal forces acting on a printing blanket during high speed printing can exceed the magnetic holding power between blanket and cylinder causing a unidirectional shift in the location of the gap with respect to the cylinder. As a consequence, printing quality is degraded, and operating costs are increased.

Thus, it would be desirable to have offset printing apparatus which would, in addition to providing a more narrow gap approaching that of a continuous blanket, maintain the gap of a blanket-covered cylinder in a constant position. Accordingly, there remains a need in the art for a printing blanket having an improved design which will result in a narrow gap on a printing cylinder and yet which maintains the blanket and the gap in a constant position.

SUMMARY OF THE INVENTION

The present invention meets the aforementioned need by providing a printing blanket having an improved end design which results in a narrow gap on a printing cylinder (i.e., blanket-covered cylinder) and which resists movement relative to the cylinder surface and maintains the gap in a constant position even during high speed printing operations. The invention provides several embodiments of printing blankets with end portions designed for satisfying the needs in the art.

In accordance with one aspect of the invention, a magnetic printing blanket adapted to be used with a magnetic printing cylinder is provided. The printing cylinder includes a gap having two edges extending longitudinally along the outer surface of the printing cylinder. The printing blanket comprises a plurality of plies with a magnetic backing ply for magnetically adhering the printing blanket to the outer surface of the printing cylinder. The backing ply has first and second ends whereby the printing blanket is positioned on the printing cylinder such that the first end of the backing ply is bent over one edge and inwardly into the gap and the second end is mounted substantially adjacent the opposite edge of the gap. The first end of the backing ply may be bent inwardly at any angle between 0° and 150°, with respect to the outer surface of the printing cylinder. With regard to the reference to the outer surface from which all angles referred to herein are measured, it should be understood that the angles are swept inwardly into the printing cylinder. For example, a backing ply bent at an angle of 0° with respect to the outer surface extends straight along the outer surface of the printing cylinder, whereas a backing ply bent at an angle of 180° is bent back upon its undersurface. In one embodiment, the plies may include an arrangement in which a first fabric ply secured to the backing ply, a compressible ply being disposed on the first fabric ply, a second fabric ply mounted onto the compressible ply, and an elastomeric surface ply mounted onto the second fabric ply. Other conventional ply arrangements and materials of construction may be used.

In another embodiment of the invention, a magnetic printing blanket having first and second end portions designed in accordance with the invention is provided. The printing blanket comprises a plurality of plies with a magnetic backing ply for magnetically adhering the printing blanket to the printing cylinder. The printing blanket is positioned on the printing cylinder such that the first end portion is bent over one edge and inwardly into the gap and the second end portion is mounted substantially adjacent the opposite edge of the gap. The first end portion may be bent inwardly into the gap at an angle from 0° to 150° with respect to the outer surface of the printing cylinder. The plies may be coextensive with the backing ply to the extent that the plies and the backing ply remain detached from one another in the first end portion. The first end portion of the printing blanket may be bent inwardly such that the backing ply is bent into the gap at a first angle with respect to the outer surface of the printing cylinder, while the plies are bent into the gap at a second angle with respect to the outer surface of the printing cylinder. The first angle may be larger than the second angle, for example, 100° and 45° respectively In another embodiment of the invention, a printing blanket adapted to be used with a printing cylinder including a gap having two edges extending longitudinally along the outer surface of the printing cylinder is provided. The printing blanket comprises a plurality of plies and a backing ply adhered to the printing cylinder. The printing blanket has first and second end portions, each having a flange secured thereto such that the flanges may be mounted within the gap. The printing blanket further comprises means for securing the flanges within the gap which may include a bar clamp or a similar securing device. The flanges are preferably secured to the end portions as individual pieces. As a further feature of this embodiment, the backing ply and the printing cylinder may be magnetic so as to magnetically adhere the printing blanket to the printing cylinder.

In yet another embodiment of the invention, a printing apparatus having a narrow gap is provided. The printing apparatus comprises a magnetic printing cylinder, and a printing blanket having first and second end portions. The printing blanket comprises a plurality of plies with a magnetic backing ply for magnetically adhering the printing blanket to the printing cylinder. The printing apparatus further comprises means for aligning the printing blanket on the printing cylinder. The aligning means preferably comprise locator tabs having apertures and corresponding locator pins which, together, maintain the printing blanket and printing cylinder in proper alignment. In one aspect of the invention, the locator pins may be positioned around an end of the printing cylinder and the locator tabs along a side edge of the printing blanket. In another aspect, the locator pins may be positioned on the outer surface of the printing cylinder and the locator tabs positioned at a side edge of the printing blanket. The locator pins and the locator tabs are interconnected to maintain proper alignment of the printing blanket on the printing cylinder.

Accordingly, it is an object of the invention to provide a printing blanket having an improved end design resulting in a narrower gap on a printing cylinder; and, to provide a printing blanket which maintains the gap in a constant position during printing operations. These and other objects and advantages of the invention will be apparent from the following detailed description, the accompanying drawings and the appended claims.

DETAILED DESCRIPTION OF THE PREFERRED EMBODIMENTS

Figure 1:
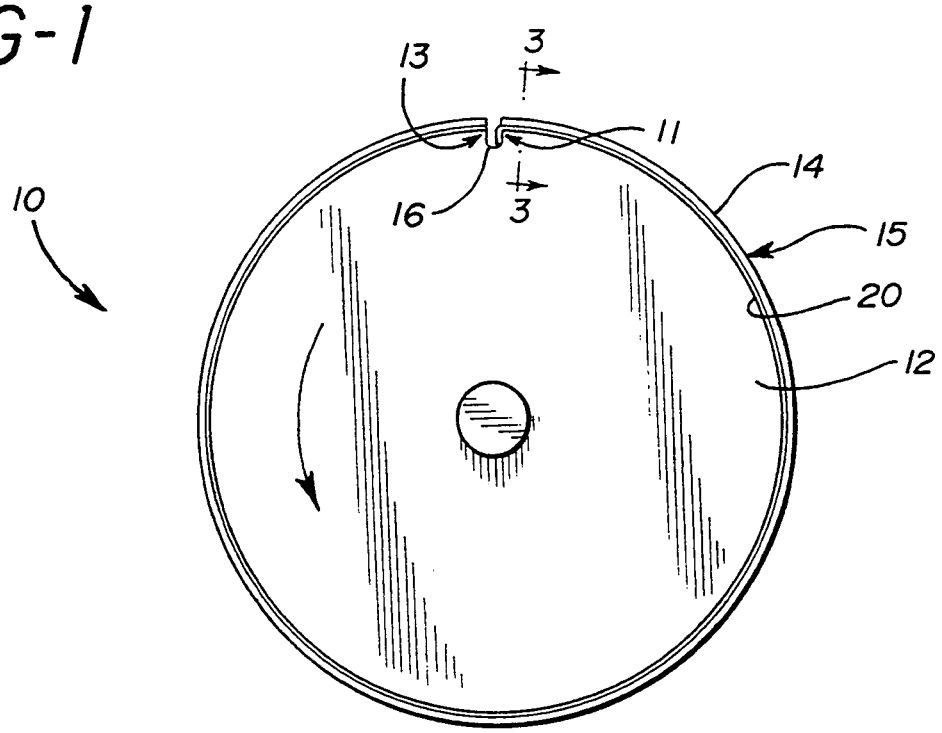
FIG. 1 is a schematic view of the printing blanket mounted on a printing cylinder in accordance with the invention.

FIG. 1 generally illustrates a portion of typical offset lithographic printing apparatus 10 which includes a magnetic printing cylinder 12 and a magnetic printing blanket 15. The printing cylinder 12 includes a gap 16 having first and second edges, 11 and 13, respectively, extending longitudinally along the outer surface of the printing cylinder 12. The printing blanket 15 comprises a plurality of plies 14 (best shown in FIG. 3) secured to a magnetic backing ply 20. The backing ply 20 is magnetically adhered to the printing cylinder 12 in a manner such that the position of the printing blanket 15 is constant with respect to the printing cylinder 12. As described more fully below, the positioning of blanket 15 will depend upon the direction in which the printing cylinder 12 rotates.

Figure 2:
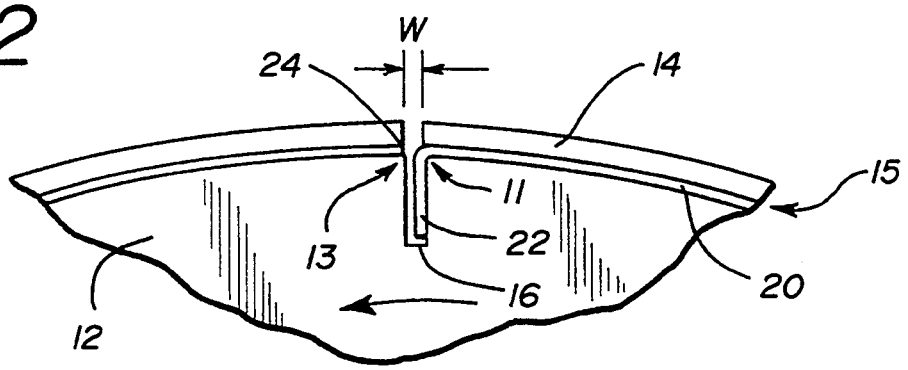
FIG. 2 is an enlarged view of the printing blanket and the gap on the printing cylinder as shown in FIG. 1.

FIG. 2 is an enlarged view of the printing blanket 15 in the area of the gap 16 and provides a better view of the manner in which the printing blanket 15 is positioned on the printing cylinder 12. The printing blanket 15 preferably comprises the plies 14, which are described more fully with respect to FIG. 3, and the magnetic backing ply 20 for magnetically adhering the backing ply 20, and thereby the printing blanket 15, to the outer surface of the printing cylinder 12. Preferably, the backing ply 20 comprises a ferrous metal resulting in the plies 14 and the backing ply 20 sometimes being collectively referred to in the art as a "metal-backed" printing blanket 15. Those skilled in the art, however, will appreciate that the backing ply 20 may formed of other materials which render the backing ply 20 magnetic without departing from the scope of the invention. For example, a ferrous metal may be coated onto ply 20, or ferrous metal particles may be impregnated in the material of ply 20.

As seen in FIG. 2, the backing ply 20 has first and second ends 22 and 24, respectively, whereby the printing blanket 15 is positioned on the printing cylinder 12 such that the end 22 is bent over the edge 11 and inwardly into the gap 16 and the end 24 is mounted substantially adjacent the edge 13 of the gap 16. It should be understood that the position of the first end 22 is shown in FIG. 2 for the printing cylinder 12 rotating in a counterclockwise direction. If, however, the printing cylinder 12 is designed to be rotated in a clockwise direction, those skilled in the art will appreciate that the respective configurations of the ends 22 and 24 would be reversed in that the end 24 would be bent inwardly into the gap 16 and the end 22 would be mounted substantially adjacent the edge 11. In this way, the circumferential forces generated by rotation of the cylinder are counterbalanced by the structural configuration of the end 22 of the backing ply 20 in order to eliminate or minimize any shift in circumferential position of the printing blanket 15.

During high speed printing operations, any shift in circumferential position of the printing blanket 15 causes an undesirable shift in the position of the printing gap width W of the gap 16. By having the end 22 of the backing ply 20 bent inwardly over the edge 11 and into the gap 16, such a shift in the gap width W is eliminated. To this end, it is preferable to have the end 22 bent inwardly into the gap 16 at substantially 100° with respect to the outer surface of the printing cylinder 12, thereby resulting in a gap width W on the order of about 0.020 inches. Accordingly, the printing blanket 15 provides a substantial improvement over prior art apparatus in which gap widths are on the order of 0.180 inches or larger.

Figure 3:
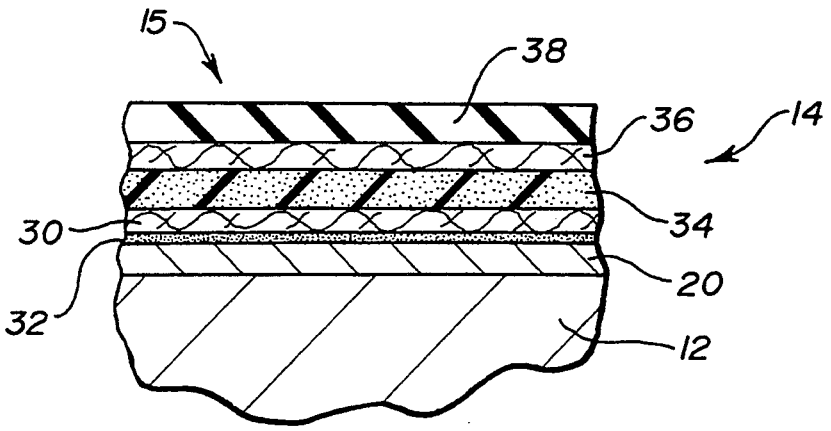
FIG. 3 is a fragmentary cross-sectional view taken along view line 3—3 in FIG. 1 of the printing blanket in accordance with the invention.

Referring now to FIG. 3, a more detailed cross-sectional view of the preferred components of the printing blanket 15 is illustrated. The plies 14 may include a fabric ply 30, a first side of which is secured to the backing ply 20 with an adhesive material 32. The plies 14 further include an optional compressible ply 34 which is disposed on a second side, opposite to the first side of the fabric ply 30, and a fabric ply 36 mounted onto the second side of the compressible ply 34. The outer surface of the printing blanket 15 preferably comprises an elastomeric printing ply 38 mounted onto the fabric ply 36. As discussed previously, since the backing ply 20 and the printing cylinder 12 are both magnetic, they may be adhered to one another by magnetic forces. It should be understood that the printing blanket 15 may include fewer or more plies in configurations other than those described herein without departing from the scope of the invention. The plies 14 are terminated at the edge 11 of gap 16 as shown in FIG. 2. The plies 14, however, will have an edge treatment at the edge 11 to prevent fluids encountered during the printing operations from infiltrating into the plies 14 of the printing blanket 15 and causing delamination thereof. Such an edge treatment may be accomplished using conventional blanket sealers which are well known in the art.

The backing ply 20 preferably comprises 430 stainless steel which is readily commercially available. The backing ply 20 preferably has a thickness in a range from about 0.010 inches to about 0.020 inches, and most preferably, a thickness of about 0.012 inches. Preferably, the adhesive material 32 has a thickness of approximately 0.003 inches and comprises a polyester film material which can be applied at an elevated temperature. Although the adhesive material 32 may comprise any adhesive material, it preferably comprises a polyester-based adhesive which is commercially available from a variety of sources. The fabric ply 30 may be partially or entirely ground to adjust the thickness thereof. The fabric ply 30 has a thickness preferably in a range from about 0.005 inches to about 0.020 inches and most preferably, a thickness of about 0.010 inches. The fabric ply 30, as well as the fabric ply 36, comprise conventional blanket fabrics which are readily commercially available.

With respect to the compressible ply 34, any known compressible or resilient material compatible with the other plies may be used in accordance with the invention. The preferable compressible ply 34, however, comprises a blend of nitrile and chloroprene-based rubber having a pore density with adequate strength and compressibility. Preferably, the compressible ply 34 will have a thickness in a range from about 0.008 inches to about 0.020 inches and most preferably, a thickness of about 0.014 inches. Lastly, the elastomeric printing ply 38 provides the printing face for the printing blanket 15. Those skilled in the art will appreciate that the preferred materials and their respective thickness may be varied or substituted without departing from the invention.

The preferred method for securing the plies 14 to the backing ply 20 is to first remove any oils or other contaminants from the surface of the backing ply 20 and then, apply a primer to prevent the reoccurrence of surface contamination and increase the ability of the adhesive film material 32 to bond. The adhesive film material 32, preferably a hot-melt polyester material as described above, is interleaved between the fabric ply 30 and the backing ply 20. It should be understood, however, that it is possible to apply an initial layer of the polyester material to a side of the fabric ply 30 to which the backing ply 20 is adhered so as to provide a "priming" adhesive film layer. Thereafter, the plies 14 and the backing ply 20 are heated and then cooled under pressure to set the adhesive film material 32, thus adhesively securing the plies 14 to the backing ply 20 resulting in the preferred printing blanket 15.

Figure 4:
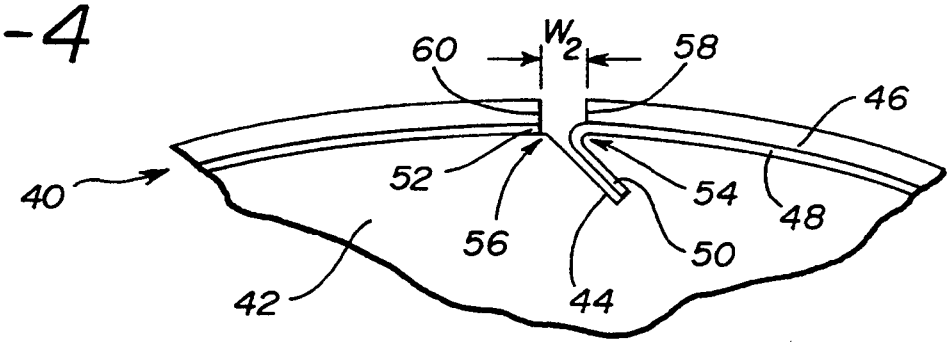
FIG. 4 is an enlarged view similar to FIG. 2 of another embodiment of the printing blanket having the backing ply bent inwardly into the gap.

In another embodiment of the invention, a printing blanket 40 as shown in FIG. 4 is provided. The printing blanket 40 is adapted to be used with a magnetic printing cylinder 42 including a gap 44 having first and second edges 54 and 56, respectively, extending longitudinally along the outer surface of the printing cylinder 42. The printing blanket 40 comprises a plurality of plies 46 with a magnetic backing ply 48 having first and second ends 50 and 52, respectively. As seen in FIG. 4, the printing blanket 40 is positioned on the printing cylinder 42 such that the end 50 of the backing ply 48 bent over the edge 54 and inwardly into the gap 44 at an angle of substantially 135° with respect to the outer surface of the printing cylinder 42. It should be understood that other angles may be used without departing from the scope of the invention. The end 52 of the backing ply 48 is mounted substantially adjacent the edge 56 of the gap 44. As clearly shown in FIG. 4, the end 50 of the backing ply 48 extends beyond a first end 58 of the plies 46 and the end 52 is substantially coextensive with the opposite end 60 of the plies 46.

By using the printing blanket 40 in accordance with the invention, a printing gap width $W_2$ results which may be somewhat wider when compared to the gap width W shown in FIG. 2, yet narrower than the gaps needed in the past by the art in which to mount blankets. It should be understood, however, that the particular dimensions of the gap width $W_2$ will depend upon the relative thickness of the printing blanket 40 used in the particular printing operation. Thus, the printing gap width. dimension of each embodiment of the invention described herein will vary accordingly. In typical printing apparatus, however, the narrower gap width $W_2$ will be a value in a range from about 0.020 inches to about 0.180 inches, thereby providing a substantial improvement over the prior art. The preferred materials for the plies 46 and the backing ply 48 are the same as those described above with respect to the plies 14 and the backing ply 20, respectively. As with the previous embodiment, since the end 58 is subject to the infiltration of printing fluids and other contaminants, the end 58 will require an end treatment as described previously so as to prevent such contaminants from seeping into the plies 46 causing delamination of the individual plies.

Figure 5:
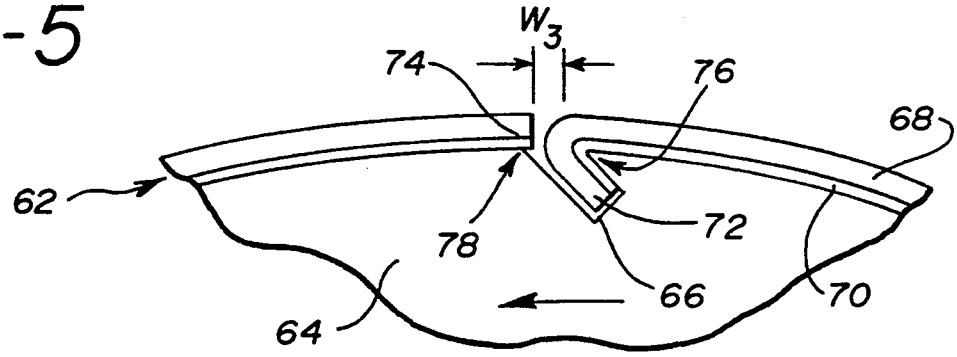
FIG. 5 is an enlarged view of another embodiment of the printing blanket having an end portion bent inwardly into the gap.

Referring now to FIG. 5, another embodiment of the invention is illustrated which includes a printing blanket 62 adapted for use with a magnetic printing cylinder 64. The printing cylinder 64 includes a gap 66 having first and second edges, 76 and 78, respectively, extending longitudinally along the outer surface of the printing cylinder 64. The printing blanket 62 comprises a plurality of plies 68 with a magnetic backing ply 70 for magnetically adhering the printing blanket 62 to the printing cylinder 64. The printing blanket 62 has first and second end portions 72 and 74, respectively. As seen in FIG. 5, the printing blanket 62 is positioned on the printing cylinder 64 such that the end portion 72 is bent over the edge 76 and inwardly into the gap 66 and the end portion 74 is mounted substantially adjacent the edge 78 of the gap 66. The end portion 72 is preferably bent inwardly into the gap 66 at an angle substantially 135° with respect to the outer surface of the printing cylinder 64. It should be understood that other angles may be used to achieve narrower gap widths without departing from the invention.

Preferably, the printing blanket 62 comprises those materials described previously with respect to the printing blanket 15. Use of the printing blanket 62, in accordance with the invention, results in a printing gap width $W_3$ which is relatively wider than the previous embodiments yet narrower than those of the past. The gap width $W_3$ may be decreased by removing a predetermined portion of the plies 68 in the end portion 72. For example, one or more of the individual plies may be skived or otherwise removed to decrease the thickness of the end portion 72 narrowing the gap width $W_3$.

Figure 6:
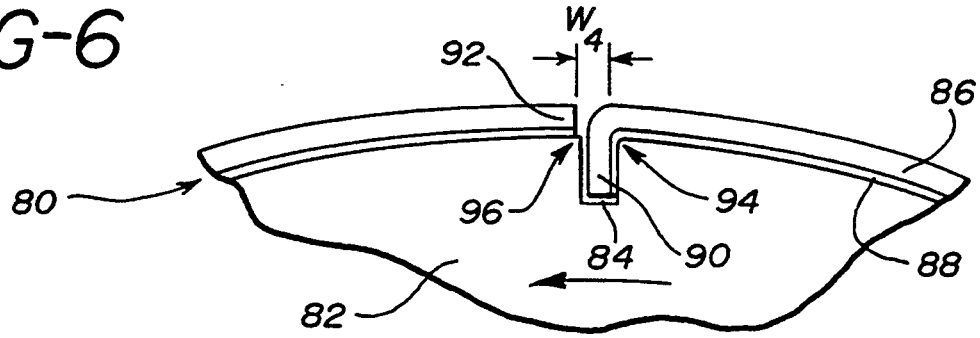
FIG. 6 is an enlarged view similar to FIG. 5 of another embodiment of the printing blanket.

FIG. 6 shows another embodiment of the invention in which a printing blanket 80 similar to the printing blanket 62 is illustrated. The printing blanket 80 is adapted to be used with a magnetic printing cylinder 82 including a gap 84 similar to the gap 66 shown in FIG. 5. As shown in FIG. 6, the printing blanket 80 comprises a plurality of plies 86 with a magnetic backing ply 88 for magnetically adhering the printing blanket 80 to the printing cylinder 82. The printing blanket 80 has first and second end portions 90 and 92, respectively, which comprise the plies 86 as well as the magnetic backing ply 88. The printing blanket 80 is positioned on the printing cylinder 82 such that the end portion 90 is bent over an edge 94 and inwardly into the gap 84 and the end portion 92 is mounted substantially adjacent an edge 96 of the gap 84. In this embodiment, the end portion 90 is bent inwardly into the gap 84 at an angle substantially 100° with respect to the outer surface of the printing cylinder 82. As with the other embodiments, other angles deviating from those described herein may be used to achieve narrower gaps.

Those skilled in the art will appreciate that the first end 90 of the printing blanket 80 or the first end 72 of the printing blanket 62 may be bent into their respective gaps at other angles without departing from the scope of the invention. By using the printing blanket 62, a printing gap width $W_4$ results which is narrower than the gap width $W_3$. The gap width $W_4$ may be decreased by removing a predetermined portion of the plies 86 from the end portion 90. For example, one or more of the individual plies may be skived or otherwise removed, thereby decreasing the thickness of the end portion 90 resulting in an even narrower gap width $W_4$. Neither the first end portion 72 nor the end portion 90 require the aforementioned edge treatment since the plies 68 and 86, respectively, are positioned within their respective gaps, thereby preventing any infiltration of contaminants into the individual plies.

Figure 7:
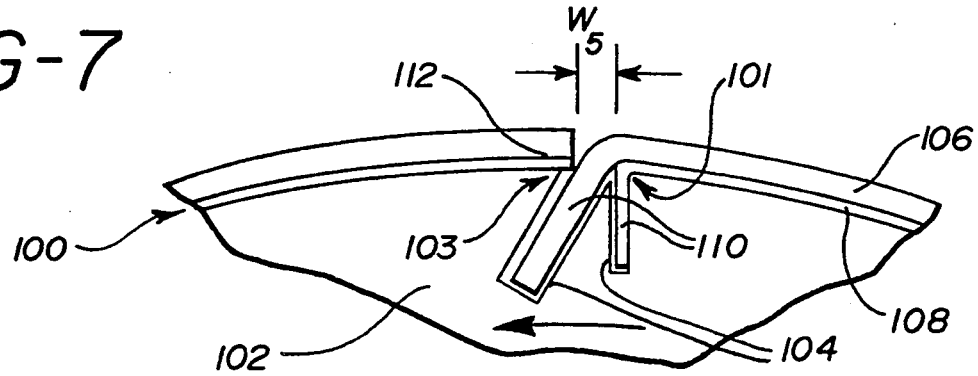
FIG. 7 is an enlarged view of another embodiment of the printing blanket in which the plies and the backing ply bent inwardly into the gap at different angles.

FIG. 7 illustrates another embodiment of the invention in which a printing blanket 100 similar to those described previously is provided. The printing blanket 100 is also adapted for use with a magnetic printing cylinder 102 which includes a gap 104 having first and second edges 101 and 103, respectively, extending longitudinally on the outer surface thereof. As shown in FIG. 7, the printing blanket 100 comprises a plurality of plies 106 with a magnetic backing ply 108, both of which comprise the preferred materials described above with respect to the printing blanket 15. The printing blanket 100 has first and second end portions 110 and 112, respectively. Preferably, the plies 106 are coextensively bonded to the magnetic backing ply 108 except that the plies 106 and the backing ply 108 remain detached from one another in the end portion 110 within the gap 104. The end portion 112 of the printing blanket 100 comprises the plies 106 and the backing ply 108 coextensively mounted substantially adjacent the edge 103.

Moreover, it is preferable to have the end portion 110 of the printing blanket 100 bent over the edge 101 and inwardly such that the backing ply 108 is bent inwardly into the gap 104 at a first angle with respect to the outer surface of the printing cylinder 102 and the plies 106 are bent inwardly into the gap 104 at a second angle with respect to the outer surface of the printing cylinder 102. The first angle at which the backing ply 108 is bent will be larger than the second angle at which the plies 106 are bent. As shown in FIG. 7, it is preferable to have the first angle at substantially 100° and the second angle to be at substantially 45° with respect to the outer surface of the printing cylinder 102. The printing blanket 100 provides a printing gap width $W_5$ which is narrower than those of the prior art. The gap width $W_5$ for typical printing apparatus is in a range from about 0.020 inches, or narrower, to about 0.180 inches. As with the embodiments shown in FIGS. 5 and 6, a predetermined portion of the plies 106 may be removed to narrow the gap width $W_5$ further.

Figure 8:
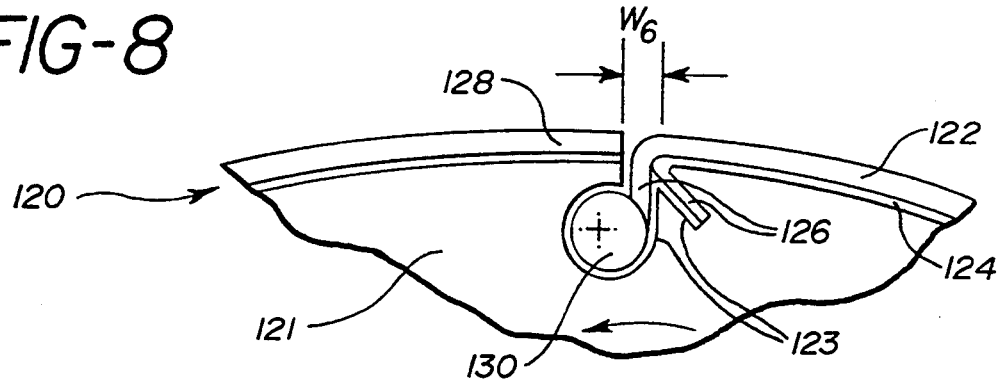
FIG. 8 is an enlarged view of another embodiment of the printing blanket in which the plies are attached to a tensioning roll.

FIG. 8 shows another embodiment of the invention in which a printing blanket 120 adapted to be used with a printing cylinder 121 including a gap 123 extending longitudinally on the outer surface thereof is provided. The printing blanket 120 has first and second end portions 126 and 128, respectively, and comprises a plurality of plies 122 and a backing ply 124, both of which comprise the aforementioned preferred materials. Further, the printing blanket 120 is similar to the printing blanket 100 illustrated in FIG. 7 in that the end portion 126 of the printing blanket 120 has the backing ply 124 bent inwardly into the gap 123 at a first angle with respect to the outer surface of the printing cylinder 121 and the plies 122 being bent inwardly into the gap 123 at a second angle with respect to the outer surface of the printing cylinder 121. Similar to the printing blanket 100, the first angle at which the backing ply 124 is bent will be larger than the second angle at which the plies 122 are bent.

As shown in FIG. 8, it is preferable to have the first angle at substantially 135° and the second angle at substantially 100° with respect to the outer surface of the printing cylinder 102. The printing cylinder 121 is provided with a tensioning roll 130 mounted within the gap 123 which serves as a means for securing the plies 122 within the gap 123. It should be understood that other securing means may be substituted for the tensioning roll 130 without departing from the scope of the invention. For example, devices referred to in the art as a reel rod or a cam lock may be used to secure the plies 122 within the gap 123. In the end portion 126, it is preferable to have a predetermined portion of the plies 122 removed to provide a narrower gap 123. The printing blanket 120 produces a printing gap width $W_6$ which represents a substantial narrowing over gap widths associated with prior art printing apparatus.

Figure 9:
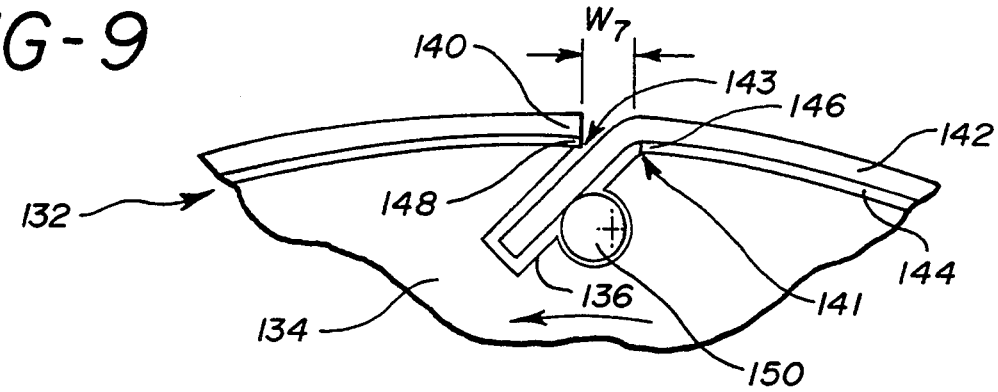
FIG. 9 is an enlarged view similar to FIG. 8 of another embodiment of the invention in which the backing ply does not extend into the gap.
Figure 10:
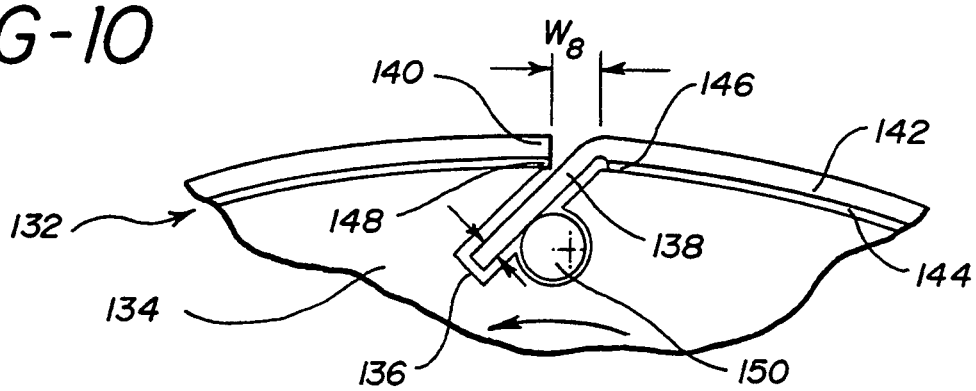
FIG. 10 is an enlarged view similar to FIG. 9 of another embodiment of the printing blanket in which a portion of the plies is removed.

Referring now collectively to FIGS. 9 and 10, a printing blanket 132 adapted to be used on a magnetic printing cylinder 134 including a gap 136 having first and second edges 141 and 143, respectively, extending longitudinally along the outer surface of the printing cylinder 134. The printing blanket 132 comprises a plurality of plies 142 with a magnetic backing ply 144 having first and second ends 146 and 148, respectively. The backing ply 144 is positioned on the printing cylinder 134 such that the end 146 of the backing ply 144 is substantially adjacent the edge 141 of the gap 136 and the end 148 is substantially adjacent the edge 143 of the gap 136. With reference specifically to the embodiment shown in FIG. 9, the printing blanket 132 has first and second end portions 138 and 140, respectively, wherein the end portion 138 comprises the plies 142 which are connected to a tensioning roll 150 or other means for securing the plies 142 within the gap 136 as described previously with respect to the tensioning roll 130. As seen in both FIGS. 9 and 10, the end portion 140 of the printing blanket 132 is substantially adjacent the edge 143. The printing blanket 132 having the end portion 138, as shown in FIG. 9, results in a narrow printing gap width $W_7$. With reference specifically to FIG. 10, the end portion 138 of the printing blanket 132 comprises only a single fabric ply being connected to the tensioning roll 150 within the gap 136. The end portion 138 provides a printing gap width $W_8$ which is narrower than the gap width $W_7$ depicted in FIG. 9.

Figure 11:
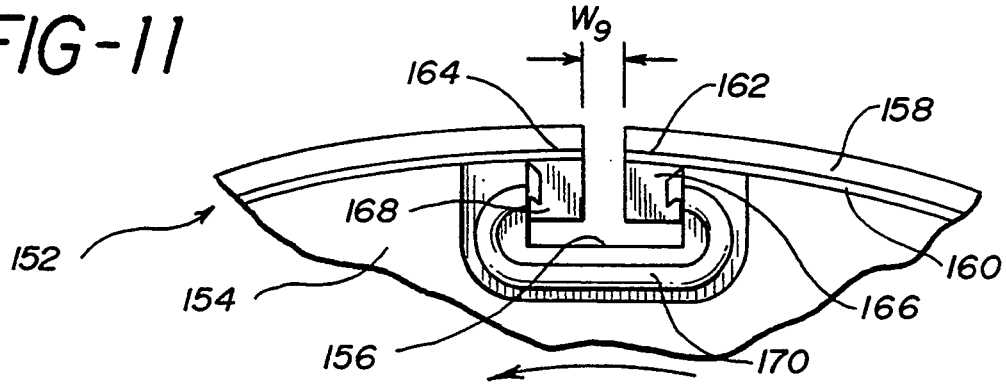
FIG. 11 is an enlarged view of another embodiment of the invention in which the printing blanket includes flanges secured in the gap with a bar clamp.

FIG. 11 illustrates another embodiment of the invention in which a printing blanket 152 is provided. The printing blanket 152 is adapted to be used with a magnetic printing cylinder 154 including a gap 156 extending longitudinally along the outer surface of the printing cylinder 154. The printing blanket 152 comprises a plurality of plies 158 with a magnetic backing ply 160 for magnetically adhering the printing blanket 152 to the printing cylinder 154. As seen in FIG. 11, the printing blanket 152 has first and second end portions 162 and 164, respectively, each having a flange 166 and 168 secured thereto. It should be understood that the flanges 166 and 168 are individual components which are secured to the first and second end portions 162 and 164, respectively, by way of an adhesive or other bonding means. The printing blanket 152 is positioned on the printing cylinder 154 such that the flanges 166 and 168 are mounted within the gap 156 and firmly secured therein with a bar clamp 170 or any other means for securing the flanges 166 and 168 within the gap 156. It should be understood that the bar clamp 170 is positioned within the printing cylinder 154 such that it may compress the flanges 166 and 168 together, thereby resulting in the printing blanket 152 being firmly secured to the printing cylinder 154. As a result, neither the printing blanket 152 nor the printing cylinder 154 is required to possess magnetic properties for securing each together. It is preferable, however, to use the magnetic backing ply 160 and the magnetic printing cylinder 154 to secure the printing blanket 152 to the printing cylinder 154 more firmly.

As a result of using the printing blanket 152, a printing gap width $W_9$ which is narrower than those exhibited in the prior art is provided. In fact, those skilled in the art will appreciate that the gap width $W_9$ can be extremely narrow, such as 0.020 inches, thereby functionally approaching a continuous blanket. Preferably, the flanges 166 and 168 comprise a metallic metal. Those skilled in the art will appreciate that other materials and configurations for the flanges 166 and 168 other than those described herein may be used without departing from the scope of the invention. For example, the flanges 166 and 168 may comprise a metal and/or have different shapes. As with the previous embodiments of the invention, plies 158 and the backing ply 160 comprise those materials described above with respect to the printing blanket 15.

Figure 12:
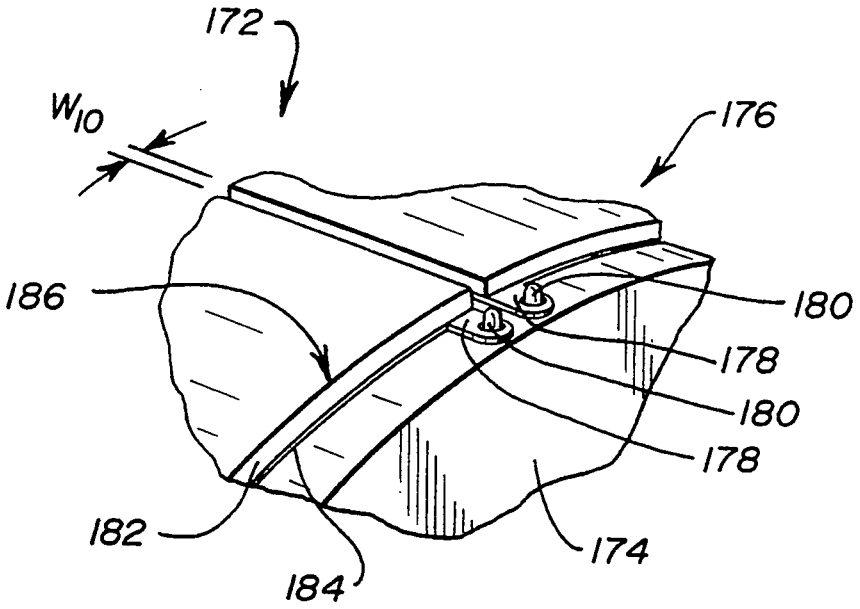
FIG. 12 is a fragmentary perspective view of another embodiment of the printing blanket in which the printing blanket is aligned on the printing cylinder with locator tabs and locator pins, respectively.
Figure 13:
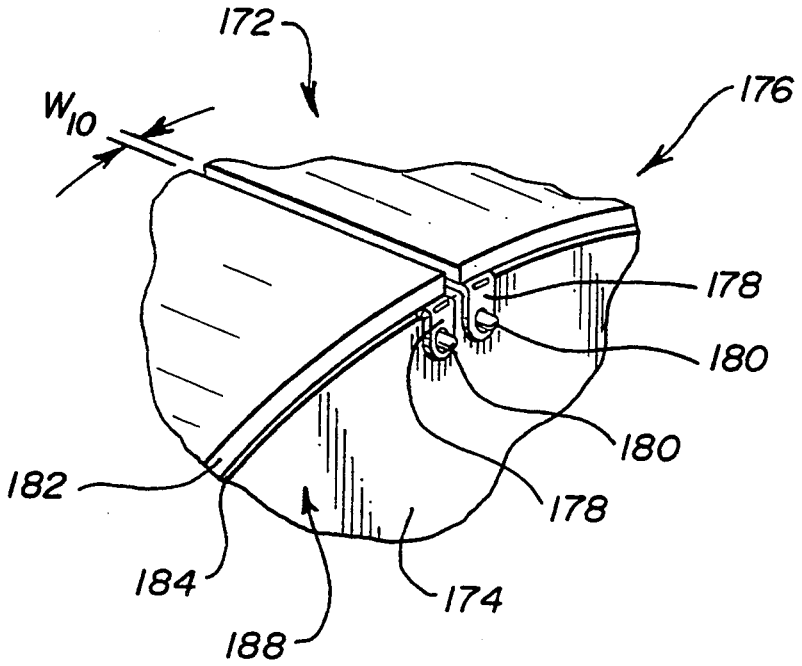
FIG. 13 is a fragmentary perspective view similar to FIG. 12 of another embodiment of the invention in which the locator pins are positioned circumferentially around the end of the printing cylinder.

Referring collectively to FIGS. 12 and 13, another embodiment generally referred to as printing apparatus 172 is shown. The printing apparatus 172 comprises a magnetic printing cylinder 174, a printing blanket 176, locator tabs 178 with apertures and corresponding locator pins 180. The locator tabs 178 and the locator pins 180, together, provide a means for aligning the printing blanket 176 on the printing cylinder 174. The locator pins 180 and the locator tabs 178 have configurations such that they may be interconnected to maintain alignment of the printing blanket 176 on the printing cylinder 174. Those skilled in the art should appreciate that a wide variety of tabs and pins and the like may be substituted for that of which is described herein. The printing blanket 176 comprises a plurality of plies 182 and a magnetic backing ply 184 for magnetically adhering the printing blanket 176 to the printing cylinder 174, both of which are preferably made from those materials described previously with respect to the printing blanket 15.

Referring specifically to FIG. 12, the locator pins 180 are positioned on the outer surface of the printing cylinder 174 and the locator tabs 178 are positioned at a side edge 186 of the printing blanket 176. Although only two locator tabs 178 and corresponding locator pins 180 are depicted in FIG. 12, it should be understood that any number of locator tabs 178 and corresponding locator pins 180 may be positioned circumferentially around the printing cylinder 174 and the side edge 186 of the printing blanket 176. FIG. 12 illustrates the resulting printing gap width $W_{10}$ which is extremely narrow and is on the order of approximately 0.020 inches. In view of this, those skilled in the art will appreciate that the printing blanket 176 permits the gap width $W_{10}$ to have a functionality approaching that of a continuous blanket.

Referring specifically to FIG. 13, the locator pins 180 are positioned around an end 188 of the printing cylinder 174 and the locator tabs 178 are positioned at the side edge 186 of the printing blanket 176 and bent over the end 188. As seen in both FIGS. 12 and 13, the locator tabs 178 and the locator pins 180 are interconnected with the locator pins 180 to maintain alignment of the printing blanket 176 on the printing cylinder 174. The resulting printing gap width $W_{10}$ is the same as that shown in FIG. 12.

Figure 14:
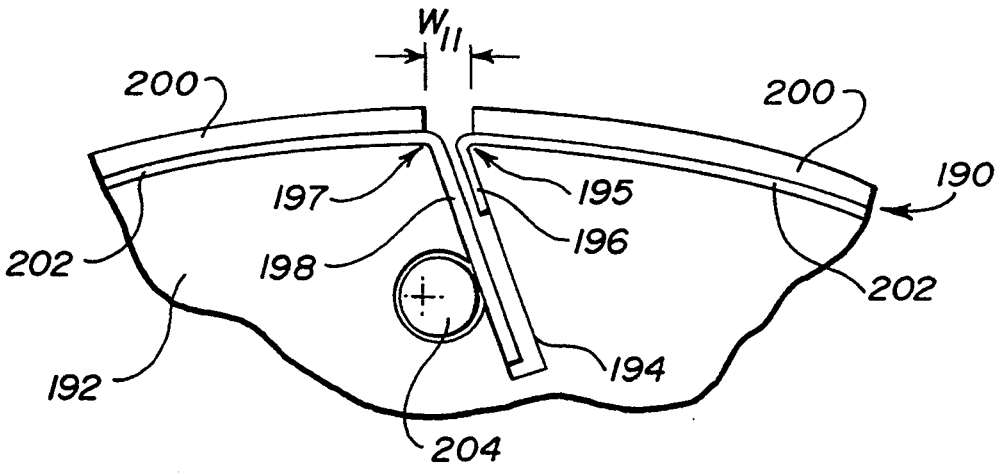
FIG. 14 is a fragmentary perspective view of another embodiment of the printing blanket having both of its ends designed such that the printing blanket can be secured to a non-magnetic printing cylinder.

FIG. 14 shows another embodiment of the invention in which a printing blanket 190 adapted to be used with a printing cylinder 192 including a gap 194 having first and second edges 195 and 197, respectively, extending longitudinally on the outer surface thereof is provided. The printing blanket 190 comprises a plurality of plies 200 and a backing ply 202 having first and second ends 196 and 198, respectively. The backing ply 202 and the plies 200 comprise the preferred materials described above with respect to FIG. 3. As seen in FIG. 14, the printing blanket 190 is similar to the printing blanket 40 illustrated in FIG. 4 in that the end 196 has the backing ply 202 bent over the edge 195 and inwardly into the gap 194 substantially at an angle of 110° with respect to the outer surface of the printing cylinder 192.

The printing blanket 190 has a design in which the end 198 secures the printing blanket 190 to the printing cylinder 192 more firmly without requiring a "magnetic" printing cylinder. More specifically, the backing ply 202 is bent over the edge 197 and inwardly into the gap 194 and secured to a tensioning roll 204 or other means for securing the backing ply 202 within the gap 194. Although the backing ply 202 may be bent inwardly at an angle between 0° (i.e. terminated at the edge 197) and 150°, it is preferable that the backing ply 202 be bent inwardly at substantially 70° with respect to the outer surface of the printing cylinder 192 while the end 196 is bent at substantially 110° with respect to the outer surface of the printing cylinder 192. By providing both of the ends 196 and 198 with the aforedescribed designs, the need for a magnetic printing cylinder is eliminated. This provides a substantial advantage over prior art printing apparatus which typically require that the printing blanket and the printing cylinder to be magnetically adhered to one another. It should be understood, however, that the printing cylinder 192 may be magnetic to secure the printing blanket 190 to the printing cylinder 192 more firmly.

The tensioning roll 204 may comprise those devices described above with respect to the tensioning roll 150 shown in FIGS. 9–10, all of which serve as a means for securing a portion of the printing blanket within a gap. Those skilled in the art will appreciate that other securing means may be substituted for the tensioning roll 204 without departing from the scope of the invention. The printing blanket 190 produces a printing gap width $W_{11}$ which represents a substantial narrowing over gap widths associated with prior art printing apparatus. Accordingly, the gap width $W_{11}$ will be in a range from about 0.020 inches to about 0.180 inches.

Figure 15:
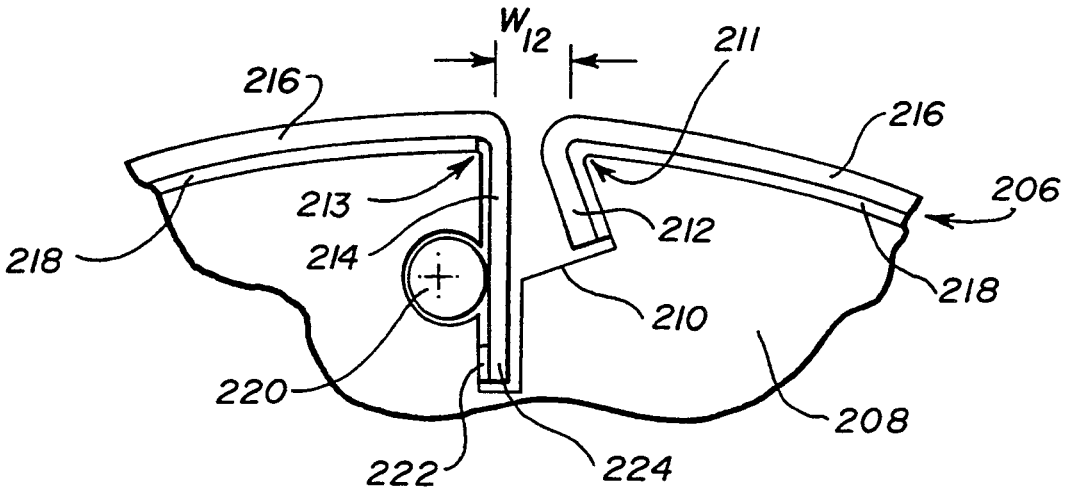
FIG. 15 is a fragmentary perspective view, similar to FIG. 14, of another embodiment of the invention in which the printing blanket is capable of being secured to a non-magnetic printing cylinder.

In yet another embodiment of the invention, a printing blanket 206 capable of being secured to a non-magnetic printing cylinder 208 is shown in FIG. 15. The printing blanket 206 includes a gap 210 having first and second edges 211 and 213, respectively, extending longitudinally on the outer surface of the printing cylinder 208. Further, the printing blanket 206 has first and second end portions 212 and 214, respectively, and comprises a plurality of plies 216 and a backing ply 218, both of which comprise aforementioned preferred materials. The end portion 212 of the printing blanket 206 is bent over the edge 211 and inwardly into the gap 210 substantially at an angle of 100° with respect to the outer surface of the printing cylinder 208. As seen in FIG. 15, the plies 216 as well as the backing ply 218 are bent inwardly in the end portion 212. Those skilled in the art will appreciate that a predetermined portion of the plies 216 may be removed so as to narrow the gap 210 further. The manner in which a portion of the plies 216 are removed may be any of those known in the art, such as skiving or grinding.

With respect to the end portion 214 of the printing blanket 206, the plies 216 are bent over the edge 213 and inwardly into the gap 210 substantially at an angle of 100° with respect to the outer surface of the printing cylinder 208. The plies 216 are secured to a tensioning roll 220 similar to the tensioning roll 204 shown in FIG. 14. It is preferable that a predetermined portion of the plies 216 in the end portion 214 be removed in order to narrow the gap 210. It is also preferable for the end portion 214 to include a weighted piece 222 which comprises a portion of the backing ply 218 positioned at the tip 224 of the end portion 214 to provide added rigidity for the plies 216 when disposed in the gap 210. As with the embodiment shown in FIG. 14, the printing blanket 206 provides a substantial improvement over the prior art in that it may be secured to a non-magnetic printing cylinder such as the printing cylinder 208 shown in FIG. 15. Printing apparatus which use the printing blanket 206 result in a printing gap width $W_{12}$ representing a more narrow gap width when compared with prior art printing apparatus. For example, the gap width $W_{12}$ will be in a range from about 0.050 inches to about 0.180 inches.

Having described the invention in detail and by reference to preferred embodiments thereof, it will be apparent that modifications and variations are possible without departing from the scope of the invention which is defined in the appended claims. For example, the printing blankets may have fewer or more plies which are constructed of materials other than those described herein.

What is claimed is:

1. A printing blanket in combination with a magnetic printing cylinder including a gap having first and second edges extending longitudinally along an outer surface of said printing cylinder, said printing blanket comprising:

a plurality of plies and a magnetic backing ply for magnetically adhering said printing blanket to the outer surface of said printing cylinder, said backing ply having first and second ends, said printing blanket being positioned on said printing cylinder such that said first end of said backing ply is bent over said first edge and inwardly into said gap and said second end is mounted substantially adjacent said second edge of said gap wherein said gap has a width of less than about 0.180 inches.

2. The printing blanket as recited in claim 1 wherein said first end is bent inwardly into said gap at substantially 100° with respect to the outer surface of said printing cylinder.

3. The printing blanket as recited in claim 1 wherein said first end is bent inwardly into said gap at substantially 135° with respect to the outer surface of said printing cylinder.

4. The printing blanket as recited in claim 1 wherein said plies include:

a first fabric ply having first and second sides, said first side of said first fabric ply being secured to said backing ply, a compressible ply having first and second sides, said first side of said compressible ply being disposed on said second side of said first fabric ply, a second fabric ply mounted onto said second side of said compressible ply, and an elastomeric printing ply mounted onto said second fabric ply.

5. The printing blanket as recited in claim 4 wherein said first fabric ply is adhesively secured to said backing ply with an adhesive film material.

6. The printing blanket as recited in claim 1 wherein said backing ply is substantially coextensive with said plies to the extent that said first end of said backing ply extends beyond said plies.

7. A printing blanket in combination with a magnetic printing cylinder including a gap having first and second edges extending longitudinally along an outer surface of said printing cylinder, said printing blanket comprising:

a plurality of plies and a magnetic backing ply for magnetically adhering said printing blanket to said printing cylinder, said printing blanket having first and second end portions and being positioned on said printing cylinder such that said first end portion is bent over said first edge and inwardly into said gap and said second end portion is mounted substantially adjacent said second edge of said gap wherein said gap has a width of less than about 0.180 inches.

8. The printing blanket as recited in claim 7 wherein said first end portion is bent inwardly into said gap at substantially 135° with respect to the outer surface of said printing cylinder, said backing ply and said plies being bonded together in said first end portion.

9. The printing blanket as recited in claim 7 wherein said first end portion is bent inwardly into said gap at substantially 100° with respect to the outer surface of said printing cylinder, said backing ply and said plies being bonded together in said first end portion.

10. The printing blanket as recited in claim 7 wherein said plies are coextensively bonded to said backing ply to the extent that said plies and said backing ply remain detached from one another in said first end portion.

11. The printing blanket as recited in claim 10 wherein said first end portion of said printing blanket is bent inwardly such that said backing ply is bent inwardly into said gap at a first angle with respect to the outer surface of said printing cylinder and said plies are bent inwardly into said gap at a second angle with respect to the outer surface of said printing cylinder, said first angle being larger than said second angle.

12. The printing blanket as recited in claim 11 wherein said first angle is substantially 100° and said second angle is substantially 45°.

13. The printing blanket as recited in claim 10 further including means for securing said plies within said gap.

14. The printing blanket as recited in claim 13 wherein said securing means comprises a tensioning roll being positioned within said gap and connected to said plies.

15. The printing blanket as recited in claim 7 wherein said plies include:

a first fabric ply having first and second sides, said first side of said first fabric ply being secured to said backing ply, a compressible ply having first and second sides, said first side of said compressible ply being disposed on said second side of said first fabric ply, a second fabric ply mounted onto said second side of said compressible ply, and an elastomeric printing ply mounted onto said second fabric ply.

16. The printing blanket as recited in claim 7 wherein a predetermined portion of said plies in said first end portion is removed.

17. The printing blanket as recited in claim 7 wherein said first end portion comprises said plies being connected to means for securing said plies within said gap, said backing ply having first and second ends and being positioned on said printing cylinder such that said first end is substantially adjacent said first edge and said second end is substantially adjacent said second edge of said gap.

18. The printing blanket as recited in claim 17 wherein a predetermined portion of said plies in said first end portion is removed.

19. The printing blanket as recited in claim 18 wherein said plies in said first end portion are attached to said securing means.

* * * * *